US008160270B2

(12) United States Patent
Oh et al.

(10) Patent No.: US 8,160,270 B2
(45) Date of Patent: Apr. 17, 2012

(54) METHOD AND APPARATUS FOR ACQUIRING MULTI-CHANNEL SOUND BY USING MICROPHONE ARRAY

(75) Inventors: Kwang-cheol Oh, Yongin-si (KR); Jae-hoon Jeong, Yongin-si (KR); Kyu-hong Kim, Yongin-si (KR); So-young Jeong, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1043 days.

(21) Appl. No.: 12/076,119

(22) Filed: Mar. 13, 2008

(65) Prior Publication Data

US 2009/0129609 A1 May 21, 2009

(30) Foreign Application Priority Data

Nov. 19, 2007 (KR) ..... 10-2007-0118086

(51) Int. Cl.
*H04R 3/00* (2006.01)

(52) U.S. Cl. ..... 381/92; 704/E21.004

(58) Field of Classification Search ..... 381/92–94; 704/E21.004

See application file for complete search history.

(56) References Cited

U.S. PATENT DOCUMENTS

| | | | | |
|---|---|---|---|---|
| 6,904,152 | B1 * | 6/2005 | Moorer | 381/18 |
| 7,046,812 | B1 * | 5/2006 | Kochanski et al. | 381/92 |
| 7,313,243 | B2 * | 12/2007 | Hsu | 381/92 |
| 2006/0095269 | A1 | 5/2006 | Smith et al. | |
| 2007/0150268 | A1 * | 6/2007 | Acero et al. | 704/226 |
| 2008/0019548 | A1 * | 1/2008 | Avendano | 381/313 |
| 2008/0199024 | A1 * | 8/2008 | Nakadai et al. | 381/92 |
| 2008/0240463 | A1 * | 10/2008 | Florencio et al. | 381/92 |
| 2009/0076815 | A1 * | 3/2009 | Ichikawa et al. | 704/233 |
| 2009/0226005 | A1 * | 9/2009 | Acero et al. | 381/92 |
| 2011/0216908 | A1 * | 9/2011 | Galdo et al. | 381/17 |

FOREIGN PATENT DOCUMENTS

KR 10-2004-0070966 8/2004

* cited by examiner

*Primary Examiner* — Nathan Ha
(74) *Attorney, Agent, or Firm* — Staas & Halsey LLP

(57) ABSTRACT

Provided are a method and an apparatus for acquiring a multi-channel sound by using a microphone array. The method estimates positions of sound sources corresponding to sound source signals, which are mixed together, from the sound source signals input via a microphone array; and generates a multi-channel sound source signal by compensating for the sound source signals, based on differences between the estimated positions of the sound sources and a position of a virtual microphone array substituting for the microphone array. By doing so, the multi-channel sound having a stereoscopic effect can be acquired from a plurality of distant sound source signals which are input via the microphone array from a portable sound acquisition device.

15 Claims, 8 Drawing Sheets

METHOD AND APPARATUS FOR ACQUIRING MULTI-CHANNEL SOUND BY USING MICROPHONE ARRAY

CROSS-REFERENCE TO RELATED PATENT APPLICATION

This application claims the benefit of Korean Patent Application No. 10-2007-0118086, filed on Nov. 19, 2007, in the Korean Intellectual Property Office, the disclosure of which is incorporated herein in its entirety by reference.

BACKGROUND

1. Field

One or more embodiments of the present invention relates to a method, medium and apparatus for acquiring a multi-channel sound from a sound acquisition device having a microphone array, and more particularly, to a method and apparatus for acquiring a multi-channel sound, such as 5.1 channel audio enabling users to feel a stereoscopic effect, from a plurality of mixed sound source signals which are input via a microphone array.

2. Description of the Related Art

A technology for recording and reproducing an audio signal has been developed from a mono-channel signal via a stereo-channel signal to a multi-channel signal. Such development is a result of users' desire to experience a more vivid and stereoscopic sound. In particular, the multi-channel signal enables a user to listen to a multi-directional audio signal from a plurality of sources, thereby providing an enhanced stereoscopic effect, compared to the mono-channel signal or the stereo-channel signal.

In order to listen to a multi-channel sound, a multi-channel audio source is required. In general, the multi-channel audio source is acquired by using one of two methods described below. The first method is to independently record a sound source for each of channels as many as required. This first method is commonly used in the production of movies or records. Hereinafter, the sound source is a term which represents a source from which sound is emitted. The second method is to position a microphone system, which is specially designed so as to simultaneously record a multi-channel audio source, according to a direction of each channel, and to record sound emitted from the corresponding direction.

As described above, in order to acquire the multi-channel sound, there are many limitations such as time, space, special recording equipment requirements, and the like. Thus, it is undesirable to apply the aforementioned multi-channel sound acquisition methods to small portable devices such as a mobile phone or a digital camcorder, which can acquire sound.

SUMMARY OF THE INVENTION

One or more embodiments of the present invention provides a method, medium and apparatus for acquiring a multi-channel sound having a stereoscopic effect from a plurality of mixed sound source signals which are input via a microphone array included in a portable sound acquisition device.

According to an aspect of the present invention, there is provided a method of acquiring a multi-channel sound, the method including operations of estimating positions of sound sources corresponding to sound source signals, which are mixed together, from the sound sources signals input via a microphone array; and generating a multi-channel sound source signal by compensating for the sound sources signals, based on differences between the estimated positions of the sound sources and a position of a virtual microphone array substituting for the microphone array.

According to another aspect of the present invention, there is provided a computer readable recording medium having recorded thereon a program for executing the method of acquiring the multi-channel sound on a computer.

According to another aspect of the present invention, there is provided an apparatus for acquiring a multi-channel sound, the apparatus including a sound source position estimator estimating positions of sound sources corresponding to sound source signals, which are mixed together, from the sound sources signals input via a microphone array; and a multi-channel sound source signal generator generating a multi-channel sound source signal by compensating for the sound sources signals, based on differences between the estimated positions of the sound sources and a position of a virtual microphone array substituting for the microphone array.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1A:
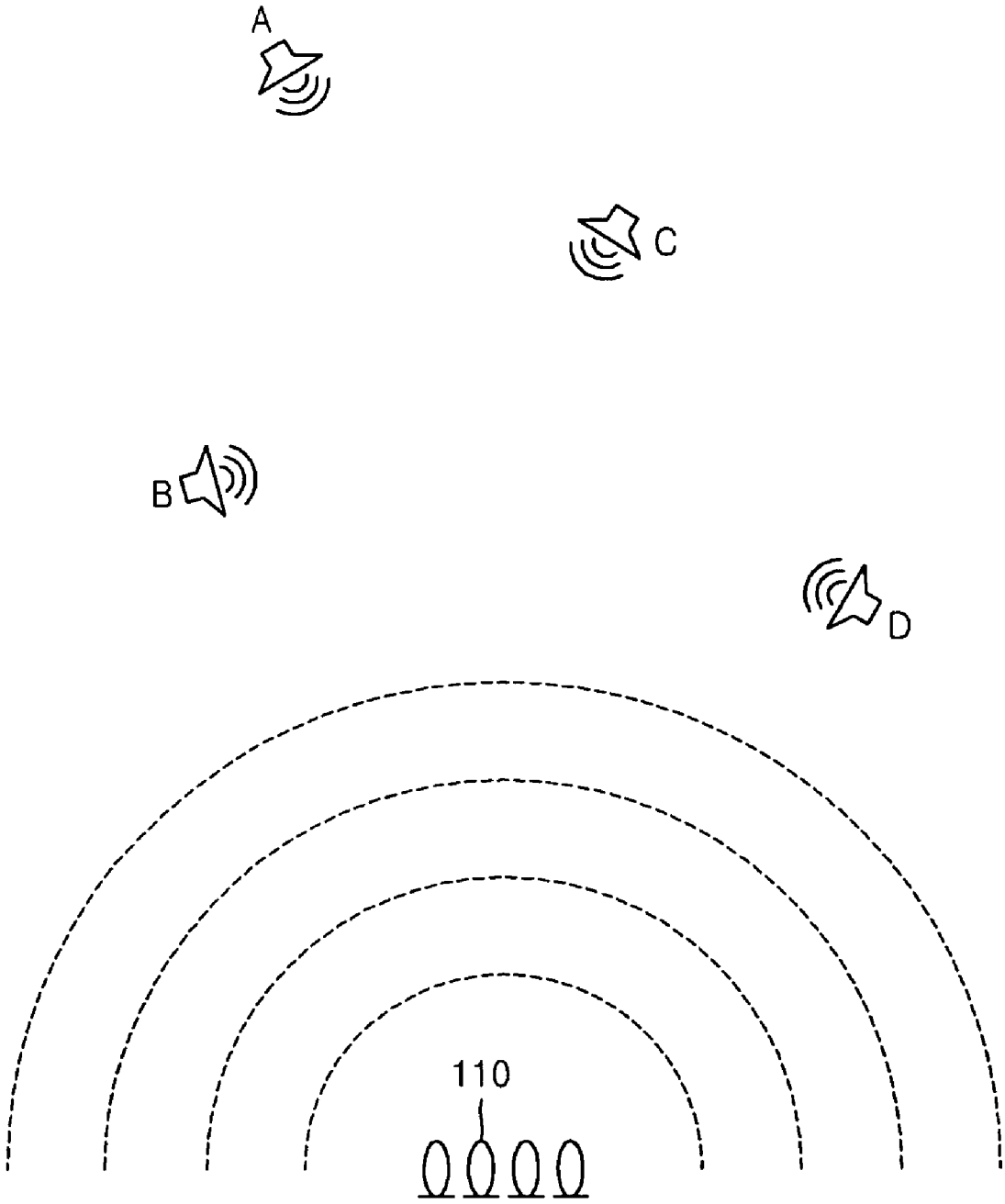
FIGS. 1A and 1B are diagrams of a circumstance and a solution, each of which representing why a problem occurs and how the problem is solved according to the embodiments.
Figure 1B:
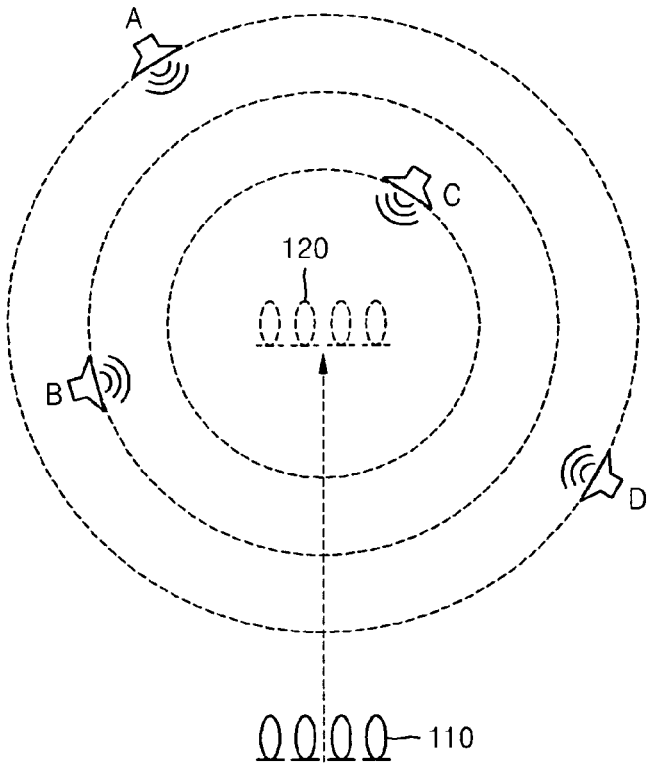

FIGS. 1A and 1B are diagrams of a circumstance and a solution, each of which representing why a problem occurs and how the problem is solved according to the embodiments.

FIG. 1A is the circumstance assumed that individual sound sources respectively exist at positions A, B, C, and D, and a microphone array 110 is located at a position that is distant from the individual sound sources. In FIG. 1A, concentric circles, which are denoted by using a dotted line, with the microphone array 110 centered therein, are visualized by linking positions which correspond to a same distance from the microphone array 110. Thus, the farther a distance between the microphone array 110 and each of the sound sources A, B, C, and D, the smaller a difference between the distances and the smaller the angular differences therebetween.

In general, a microphone array arranges a plurality of microphones, thereby acquiring not only sound itself but also an additional characteristic about a directivity such as a direction or a position, which are of the sound to be acquired. The directivity represents a sensitivity with respect to a sound source signal, which is emitted from a sound source located at a specific direction, is enlarged by using a temporal difference that occurs since sound source signals reach a plurality of microphones comprising the microphone array at different times. Thus, the sound source signal input from the specific direction can be emphasized or restrained by acquiring the sound source signals by using such a microphone array.

However, in FIG. 1A, when the distance between the microphone array 110 and the sound sources A, B, C, and D is far, sound emitted from the sound sources A, B, C, and D mostly reaches a front of the microphone array 110. Also, due to a size limitation of portable digital devices, a size of the microphone array 110 included in the portable digital devices is obliged to be small. In addition, in the case where the sound is acquired from a distance as described above, the difference in terms of distances and the angular difference between the microphone array 110 and the sound sources A, B, C, and D are reduced. Thus, a problem occurs in that clear multi-channel sound cannot be acquired from the sound emitted from the sound sources A, B, C, and D.

FIG. 1B illustrates a case in which the microphone array 110 is assumed to exist at a position in the vicinity of the sound sources A, B, C, and D, as a virtual microphone array 120 in the same circumstance as that of FIG. 1A. Similar to FIG. 1A, concentric circles, which are denoted by using a dotted line, are visualized by linking positions which correspond to a same distance from the virtual microphone array 120. In FIG. 1B, each of the sound sources A, B, C, and D exists in the vicinity of the virtual microphone array 120, forming various angles and distances with the virtual microphone array 120. Thus, when the sound emitted from the sound sources A, B, C, and D is acquired via the virtual microphone array 120, the multi-channel sound may be easily acquired. Based on such an idea, hereinafter, how the virtual microphone array 120 is realized and how the multi-channel sound is acquired will be described.

Figure 2:
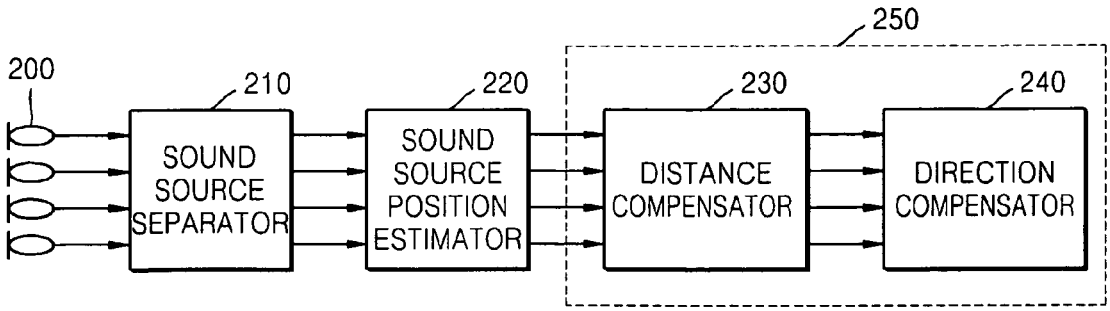
FIG. 2 is a block diagram illustrating a multi-channel sound acquisition apparatus using a microphone array according to an embodiment of the present invention.

FIG. 2 is a block diagram illustrating an apparatus for acquiring multi-channel sound by using a microphone array according to an embodiment of the present invention. The apparatus for acquiring the multi-channel sound (hereinafter, referred to as 'multi-channel sound acquisition apparatus') includes a microphone array 200, a sound source separator 210, a sound source position estimator 220, and a multi-channel sound source signal generator 250. The multi-channel sound source signal generator 250 includes a distance compensator 230 and a direction compensator 240.

The microphone array 200 receives various sound source signals emitted from sound sources via a plurality of microphones comprising the microphone array 200.

The sound source separator 210 separates each of the sound source signals from a mixed sound input via the microphone array 200, by using various sound source separation algorithms that will be described later. The sound source signals input via the microphone array 200 are signals mixed together and including various sounds emitted from the sound sources. Thus, in order to extract multi-channel sound from such a mixed signal, a procedure of separating the individual sound source signals from the mixed signal has to be first performed. Widely known methods of separating the individual sound source signals are a separation method which uses a statistical attribute of a sound source signal itself, a separation method which uses an attribute difference between each of sound source channels, and a separation method based on position information of a sound source. Hereinafter, the separation method using the statistical attribute is primarily described. However, other separation methods will also be briefly described.

First, the separation method using the statistical attribute of the sound source signal itself is introduced. Blind source separation (BBS) is the separation of original sound source signals from a mixed signal in which a plurality of sound source signals are mixed. That is, the purpose of the BBS is to separate each source from the mixed signal, without the aid of information about signal sources. An independent component analysis (ICA) technique is used when performing such BBS and corresponds to the separation method which uses the statistical attribute.

The ICA technique searches for signals before the signals are mixed and for a mixing matrix by using only a condition supposing that signals, which are mixed together and collected via a microphone, are statistically independent from original signals. Here, the statistical independence means that individual signals comprising the mixed signal do not provide any information about the corresponding original signals. That is, the sound source separation by using the ICA technique can output only sound source signals which are statistically independent from each other and does not provide information about the nature of the separated sound source signals. Thus, a procedure of estimating position information of sound sources corresponding to the separated sound source signals is required. The widely known ICA techniques are infomax, FastICA, and JADE which can be easily understood by one of ordinary skill in the art to which the embodiment pertains.

Second, the separation method using the attribute difference between each of the sound source channels will now be briefly described. This separation method uses a time-frequency masking. Here, the 'masking' represents a phenomenon in which a signal is distinguished from other signals by a specific signal. To be more specific, a window filtering operation is performed on sound source signals input via microphones (which correspond to sound source channels), fast Fourier transformation into a time-frequency domain is performed, and then an amplitude ratio and a phase difference, which are between each of the sound source channels, are generated from created frames. Here, the 'frame' means a unit created by separating the sound source signals by a constant period, according to a time change. In general, for a digital signal process, a signal is separated by the constant period that is the frame, and then is processed so as to limit the signal input to a corresponding system. At this time, a window function is used as a special filter for separating a sound source signal that is consecutive according to a time flow, frame by frame In this manner, an attenuation value and a delay value are respectively calculated from the created amplitude ratio and phase difference, a signal having a stronger energy value is selected from a correlation between the attenuation value and the delay value, so that the individual sound source signals are separated. That is, the sound source signals can be separated by using the masking which uses the attribute difference between each of the sound source channels.

Third, the separation method based on the position information of the sound source will now be briefly described. In general, in order to clearly receive a target signal which is mixed with background noises, a microphone array including at least two microphones increases an amplitude by allowing a proper weight to each signal received by the microphone array, and serves as a filter which can spatially reduce noise that occurs in the case where the desired target signal and an interference noise signal have different directions. Such a filter (that is, a spatial filter) is called a beam-former.

By using the beam-former, the separation method based on the position information variously delays sound which is input to the microphone array, and determines whether a sound source exists in a specific direction. Here, the position information of the sound source means a direction in which the sound source exists, in consideration of a reference point (which may be the microphone array). In other words, when each of the microphones included in the microphone array is differently delayed, each of the microphones has a directivity with respect to a sound source signal existing at the specific direction. This procedure is performed for every direction. If, a sound pressure of the sound source signal input from the specific direction has a maximum value, it may be determined that the sound source exists in the corresponding direction. Then, the delay value is decided, wherein the delay value corresponds to the specific direction in which the sound source is determined to exist, and the corresponding sound source signal is extracted, so that the sound source signals can be separated from the mixed signal.

Various methods of separating the sound source signals from the mixed signal by using the sound source separator 210 have been described above. The separation methods may be embodied as various embodiments according to the present invention, and can be easily understood by one of ordinary skill in the art to which the embodiment pertains.

The sound source position estimator 220 estimates positions of sound sources from the sound source signals which are separated by the sound source separator 210, wherein the sound sources correspond to the sound source signals. Here, the positions of the sound sources mean directions in which the sound sources exist, and mean distances between the sound sources and the sound source position estimator 220. A method of estimating the positions of the sound sources may vary according to how the input sound sources are supplied. Also, the method of estimating the positions of the sound sources by the sound source position estimator 220 may vary according to the sound source separation method used by the sound source separator 210. For example, in the case where the sound sources are separated by using a beam-former, direction information about the positions of the sound sources was already obtained via the sound source separation procedure. Thus, only distance information is required to be obtained. However, the position information of the sound source signals separated by using the ICA technique is not obtained at all, thus, the position information about sound sources corresponding to each of the sound source signals has to be estimated by using the sound source position estimator 220. Hereinafter, a procedure for estimating the positions of the sound source signals, which are separated by using the ICA technique from among the various sound source separation methods, will be described.

First, a transfer function is estimated. The transfer function relates to a mixing channel when the sound sources are input to the microphone array 200, as the mixed signal. Here, the transfer function of the mixing channel means a transfer function between each of the sound sources and each of a plurality of microphones, and means a function for representing a transfer characteristic of a system in which each of the sound sources is an input and signals reached the microphones are outputs. To be more specific, a procedure of estimating the transfer function of the mixing channel comprises the sound source separator 210 deciding an unmixing channel about a correlation between the mixed signal and the separated sound source signals by performing the statistical sound source separation procedure by using a learning rule of the ICA technique. The decided unmixing channel has an inverse correlation with the transfer function to be estimated by the sound source position estimator 220. Thus, the sound source position estimator 220 calculates an inverse of the decided unmixing channel, thereby estimating the transfer function. After that, the transfer function estimated for each of the separated sound source signals is multiplied, so that an input signal of the microphone array 200 may be acquired when a single sound source exists. Next, the sound source position estimator 220 estimates the positions of the sound sources from the acquired input signal of the microphone array 200. When the input signal of the microphone array 200 is acquired, the position information of each of the sound sources is estimated by using various sound source position estimation methods such as a time delay of arrival (TDOA) method, a beam-forming method, a spectral analysis method, and the like. These various sound source position estimation methods can be easily understood by one of ordinary skill in the art to which the embodiment pertains. The TDOA method will now to be briefly described.

According to the TDOA method, with respect to a signal which is input to the microphone array 200 from a sound source, the sound source position estimator 220 pairs each of two microphones included in the microphone array 200, measures a time delay between each pair of microphones, and estimates a direction of the sound source from the measured time delay. Then, the sound source position estimator 220 estimates that the sound source exists at a spatial point where the directions of the sound sources mutually overlap, wherein the directions are estimated from each pair of microphones, so that direction information and distance information regarding the position of the sound source are obtained.

In the above, the method of estimating the position of the sound source by using the sound source position estimator 220 is described. As described above, the estimation of the position of the sound source varies according to the method of separating the sound source signals from the mixed signal by the sound source separator 210. Since various methods regarding such sound source separation methods and sound source position estimation methods are known, one of ordinary skill in the art to which the embodiment pertains may easily mix various embodiments of the sound source separator 210 and the sound source position estimator 220.

The multi-channel sound source signal generator 250 compensates for the sound source signals based on differences between the positions of the sound sources estimated by the sound source position estimator 220 and a position of a virtual microphone array substituting for the microphone array 200, thereby generating a multi-channel sound source signal. The multi-channel sound source signal generator 250 will now be described in detail by describing the distance compensator 230 and the direction compensator 240 which are included in the multi-channel sound source signal generator 250.

The distance compensator 230 compensates for the sound source signals, which are separated by the sound source separator 210 (here, an amplitude of the sound source signals may be compensated), by a difference between the sound sources estimated by the sound source position estimator 220 and the virtual microphone array assumed to be based on a multi-channel sound. By doing so, the distance compensator 230 generates sound source signals corresponding to the position of the virtual microphone array. Here, as described in relation to FIG. 1B, the virtual microphone array is created by assuming that a virtual microphone array identical to an actual microphone array exists at a position in the vicinity of the sound sources so as to acquire the multi-channel sound. The position of such a virtual microphone array may be an arbitrary position which is set between the sound sources and the actual microphone array, in consideration of the positions of the sound sources estimated by the sound source position estimator 220, so as to be close to the sound sources and to acquire the multi-channel sound. For example, the virtual microphone array may be set to be positioned at the very center of a group formed by the sound sources.

Hereinafter, a procedure of compensating for the amplitude of the sound source signals by the distance compensator 230 will be described in detail with reference to FIGS. 4 through 5B. First, a circumstance including a problem will now be described with reference to FIGS. 5A and 5B, and then a configuration illustrated in FIG. 4 will be described.

Figure 4:
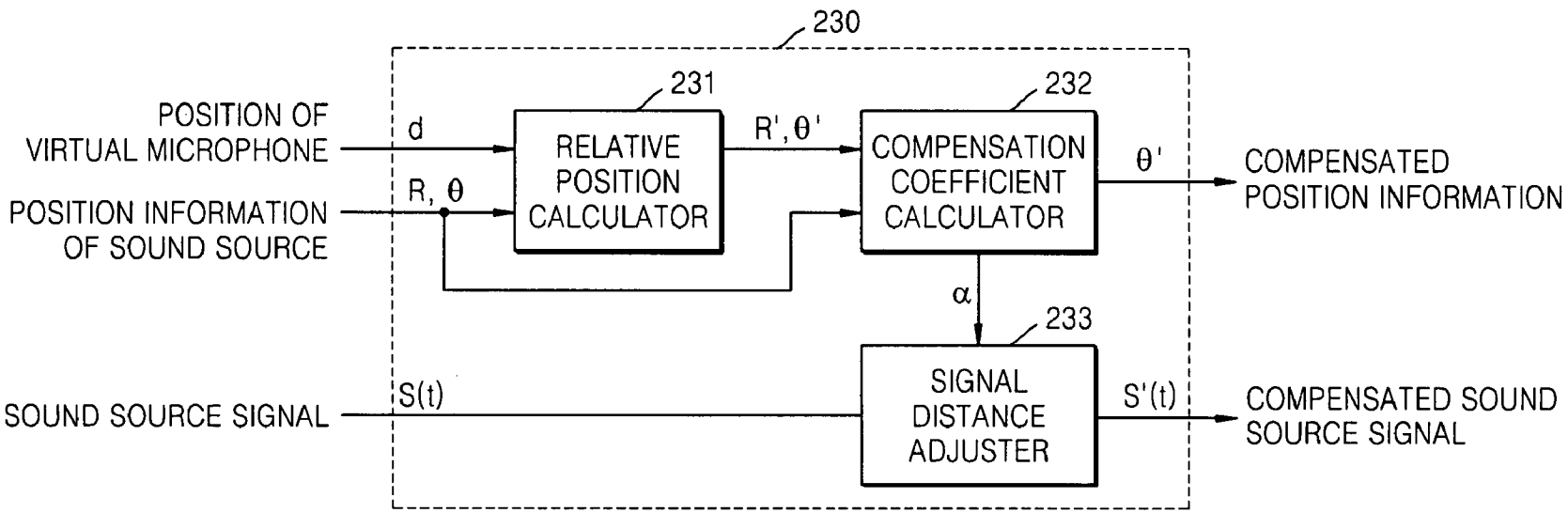
FIG. 4 is a block diagram illustrating in detail a distance compensator included in the multi-channel sound acquisition apparatus using a microphone array, according to an embodiment of the present invention.
Figure 5A:
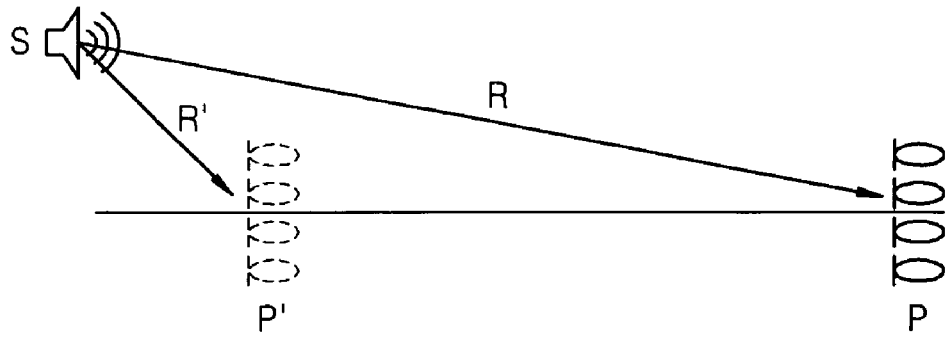
FIGS. 5A and 5B are diagrams illustrating the circumstance and a method which relate to a calculation of a relative position by using a relative position calculator of FIG. 4.
Figure 5B:
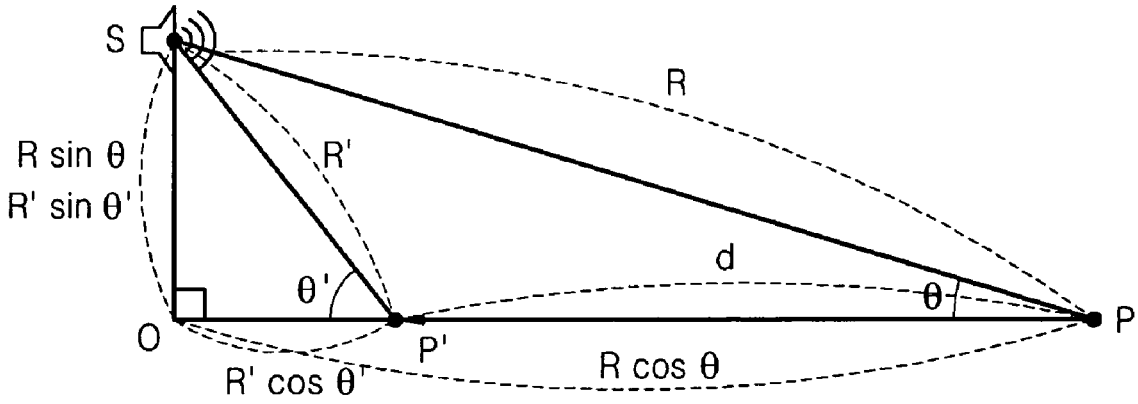

FIGS. 5A and 5B are diagrams illustrating each of the circumstance and a method which relate to a calculation of a relative position by using a relative position calculator 231 of FIG. 4. In FIG. 5A, it is assumed that an actual microphone array exists at a position P which is separated by a distance R from a sound source S. At this time, it is assumed that a virtual microphone array exists at an arbitrary position P' that is closer to the sound source S, compared to the actual microphone array at the position P. A distance between the sound source S and the virtual microphone array at the position P is referred to as a distance R'.

In FIG. 5B, variables are illustrated, wherein the variables are to be used by the relative position calculator 231 of FIG. 4. The distance (SP) between the sound source S and the actual microphone array at the position P, and the distance (SP') between the sound source S and the virtual microphone array at the arbitrary position P' are respectively referred to as R and R'. Also, an angle between the sound source S and the actual microphone array at the position P, and an angle between the sound source S and the virtual microphone array at the arbitrary position P' are respectively referred to as θ and θ'. A distance (PP') between the actual microphone array at the position P and the virtual microphone array at the arbitrary position P' is referred to as d. If each side of a right triangle is obtained by using the variables, SO=R×sin θ or SO=R'×sin θ', OP=R×cos θ, and OP'=R'×cos θ'. Hereinafter, FIG. 4 will be described with reference to these variables.

FIG. 4 is a block diagram illustrating in detail the distance compensator 230 included in the multi-channel sound acquisition apparatus using a microphone array, according to an embodiment of the present invention. The distance compensator 230 includes the relative position calculator 231, a compensation coefficient calculator 232, and a signal distance adjuster 233.

The relative position calculator 231 receives position information (R, θ) about the sound source S estimated by a sound source position estimator (the sound source position estimator 220 of FIG. 2), and position information (d) about a virtual microphone which is arbitrarily set, thereby calculating a relative position (R', θ') of the sound source S in relation to the virtual microphone array. This will now be described in detail.

As described above in relation to FIG. 5B, the variable corresponding to the side SO of the right triangle is defined as the sum of R×sin θ or the sum of R'×sin θ', wherein the side SO has the same value as given by Equation 1.

$$R' \sin\theta' = R \sin\theta \quad \text{[Equation 1]}$$

Also, in FIG. 5B, the side OP of the right triangle is equal to the sum of OP' and PP', as defined in Equation 2.

$$R' \cos\theta' + d = R \cos\theta \quad \text{[Equation 2]}$$

In Equations 1 and 2, the variables R, θ, and d are already known values, and the variables R' and θ' are unknowns. Thus, simultaneous equations are set, having two unknowns and two equations. Solutions of the simultaneous equations is obtained and are given by Equations 3 and 4.

$$R' = \{R^2 + d^2 - 2dR\cos\theta\}^{1/2} \quad \text{[Equation 3]}$$

$$\theta' = \tan^{-1}\left(\frac{R\sin\theta}{R\cos\theta - d}\right) \quad \text{[Equation 4]}$$

Thus, by using the aforementioned equations, the relative position calculator 231 may calculate the relative position (R', θ') of the sound source S in relation to the virtual microphone array.

Based on the relative position calculated by the relative position calculator 231, the compensation coefficient calculator 232 calculates a distance compensation coefficient corresponding to a difference between a distance from the sound source S to the actual microphone array and a distance from the sound source S to the virtual microphone array. Here, the distance compensation coefficient is a value for changing a gain of an amplitude so that a sound source signal input from the actual microphone array is compensated for, so as to be a sound source signal input from the virtual microphone array. Such a distance compensation coefficient may be obtained from a wave equation in which the amplitude is attenuated when a wave proceeds, as given by Equation 5.

$$x(t, r) = \frac{A}{4\pi r} e^{j(wt-kr)} \quad \text{[Equation 5]}$$

Here, t, r, A, w, and K respectively represent time, a distance from the sound source S, the amplitude, a frequency, and a wave number. x(t, r) represents a sound pressure in relation to the distance and the time, with the distance and the time treated as independent variables. It is possible to understand that when a sound wave of a sine wave proceeds by the distance r, the sound pressure (or a sound source energy) becomes smaller. That is, the distance r from the sound source S and the sound pressure are inversely proportional to each other. This may be verified by using an absolute value of the sound pressure, as defined in Equation 6.

$$|x(t, r)| = \left|\frac{A}{4\pi r} e^{j(wt-kr)}\right| = \left|\frac{A}{4\pi r}\right| \quad \text{[Equation 6]}$$

In Equation 6, $e^{j(wt-kr)}$ is converged into 1, thus, Equation 6 is in inverse proportion to the distance r from the sound source S.

When an input signal, that is, sound emitted from the sound source S and input to the actual microphone array, is referred to as s(t), and an input signal, that is, the sound emitted from the sound source S input to the virtual microphone array, is referred to as s'(t), the distance compensation coefficient for converting the input signal s(t) into the input signal s'(t) is obtained by using Equation 7 which is derived from Equation 6.

$$\alpha \equiv \frac{|s'(t, R')|}{|s(t, R)|} = \frac{\left|\frac{A}{4\pi R'}\right|}{\left|\frac{A}{4\pi R}\right|} = \frac{R}{R'} \quad \text{[Equation 7]}$$

Here, $\alpha$ is the distance compensation coefficient, and is defined as a ratio of absolute values of the input signal s(t, R) of the actual microphone array and of the input signal s'(t, R) of the virtual microphone array. When common variables of a denominator and a numerator in Equation 7 are erased, the ratio becomes a ratio of the distance R between the sound source R and the actual microphone array and the distance R' between the sound source R and the virtual microphone array. That is, Equation 7 means that the distance compensation coefficient is decided by the distances R and R'. As described above, the compensation coefficient calculator 232 calculates the distance compensation coefficient which corresponds to the difference between the distance R and the distance R'.

The signal distance adjuster 233 adjusts a size of the sound source signals, according to the distance compensation coefficient calculated by the compensation coefficient calculator 232. This procedure is performed by multiplying the sound source signals by the calculated distance compensation coefficient, as given by Equation 8.

$$s'(t)=\alpha \cdot s(t) \quad \text{[Equation 8]}$$

Here, s(t) is the original sound source signal and is used to generate a distance-compensated sound source signal s'(t) by being multiplied with the distance compensation coefficient $\alpha$.

The procedure for compensating for the distance between the actual microphone array and the virtual microphone array by the distance compensator 230 has been described above. Hereinafter, referring back to FIG. 2, a procedure after the distance compensator 230 will be described.

The direction compensator 240 compensates for the sound source signals, which are generated by the distance compensator 230 (this means that the directions of the sound source signals are compensated for), by a difference of angles formed between the virtual microphone array and each of the sound sources, and generates a multi-channel sound source signal. The compensation of the directions of the sound source signals means that the sound source signals are compensated for, in consideration of the angles, assuming that a plurality of microphones are arranged so as to acquire the sound source signals from every direction from 0 to 360 degrees by using the virtual microphone array in which the plurality of microphone phones are aligned in a line. That is, the directions are compensated for up to the angles formed between the virtual microphone array and each of the sound sources, with respect to the sound source signals obtained by using the virtual microphone array including therein the plurality of aligned microphones, so that the multi-channel sound may be acquired. This will now be described in detail with reference to FIG. 6.

Figure 6:
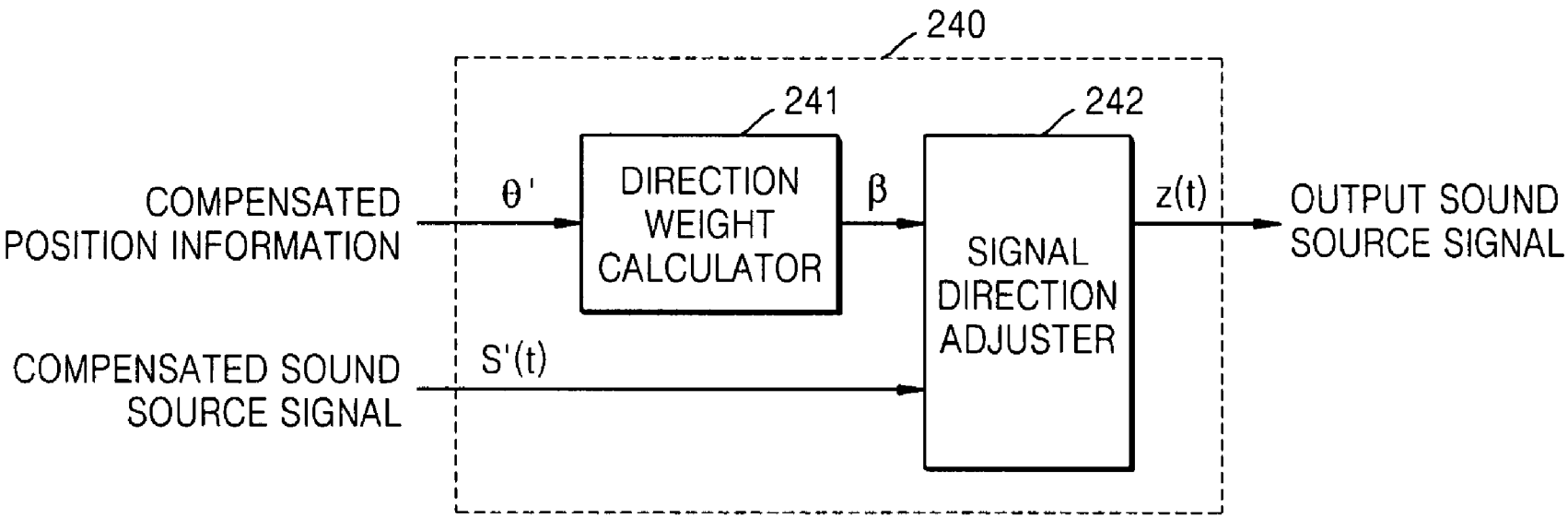
FIG. 6 is a block diagram illustrating in detail a direction compensator included in the multi-channel sound acquisition apparatus using a microphone array, according to an embodiment of the present invention.

FIG. 6 is a block diagram illustrating in detail the direction compensator 240 included in the multi-channel sound acquisition apparatus using a microphone array, according to an embodiment of the present invention. The direction compensator 240 includes a direction weight calculator 241 and a signal direction adjuster 242. The direction weight calculator 241 receives compensated position information from a distance compensator (the distance compensator 230 of FIG. 2), and calculates a direction weight according to the angles formed between the virtual microphone array and each of the sound sources. A method of calculating the direction weight will now be described with reference to FIG. 7.

Figure 7:
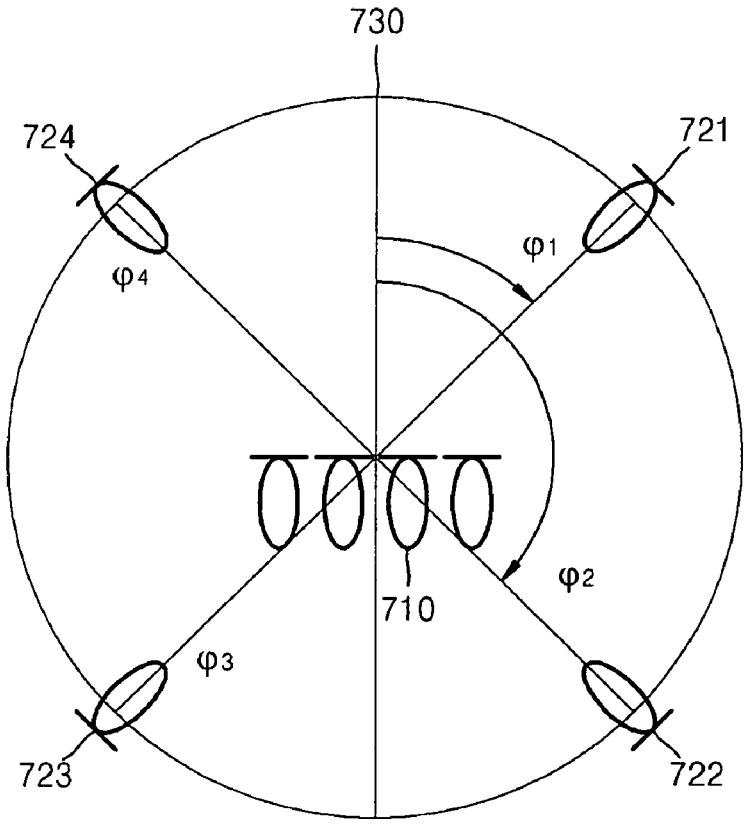
FIG. 7 is a diagram of a method of calculating a direction weight by using a direction weight calculator of FIG. 6.

FIG. 7 is a diagram of the method of calculating the direction weight by using the direction weight calculator 241 of FIG. 6. In FIG. 7, a virtual microphone array 710 including four individual microphones is assumed to exist. In a circle illustrated in FIG. 7, it is assumed that four virtual microphones 721, 722, 723, and 724 exist in directions which are different from each other, with the virtual microphone array 710 existing at a center of the circle. It is advisable to evenly dispose such virtual microphones 721, 722, 723, and 724 at each direction so as to vividly acquire sound which is input from every direction from 0 to 360 degrees. For example, as illustrated in FIG. 7, in the case where the number of individual microphones is four, the virtual microphones 721, 722, 723, and 724 may be disposed every 90 degrees. In the case of a stereo channel, the virtual microphones may be disposed every 180 degrees. Such a disposition of the virtual microphones may be properly arranged, in consideration of an environment in which embodiments of the present invention are embodied.

After a reference direction 730 is set, angles between the reference direction 730 and each of the four virtual microphones 721, 722, 723, and 724 are set, respectively being referred to as $\phi_1$, $\phi_2$, $\phi_3$ and $\phi_4$. An interval between the virtual microphone array 710 and each of the four virtual microphones 721, 722, 723, and 724 is even. Thus, the four virtual microphones 721, 722, 723, and 724 differently acquire the sound source signals emitted from the sound sources, according to a corresponding direction $\phi_i$.

The direction weight calculator 241 of FIG. 6 has to compensate for the sound source signals, thereby obtaining an effect in which the virtual microphone array 710 acquires sound as if the sound were acquired at corresponding positions of the respective virtual microphones 721, 722, 723, and 724. A signal difference between each of the sound source signals which are input to a center of the virtual microphone array 710 has been already compensated for with respect to the distance, by using the distance compensator 230 as described in FIG. 4, and thus, a signal difference between each of the sound sources signals is now to be compensated for, by the direction compensator 240 of FIG. 6, with respect to an effect depending on the direction.

The direction weight calculated by the direction weight calculator 241 has to be a value which is relatively larger for the sound source signals emitted from the sound sources existing in a direction adjacent to a direction of the virtual microphone array 710, compared to the sound source signals emitted from the sound sources exiting in a direction distant from the direction of the virtual microphone array 710. That is, the direction weight may be the value which increases when the positions of the sound sources approach_a maximum sensitivity direction of the virtual microphone array 710. Here, the maximum sensitivity direction means a direction in which a virtual microphone array senses, at a maximum level, the sound source signals. In general, the maximum sensitivity direction may be a front direction of the virtual microphone array. Methods of calculating the direction weight may vary according to the aforementioned concept, and one of the methods is given by Equation 9.

$$\beta_{ik} = \begin{cases} \cos^2\left(\frac{\pi}{2}\frac{\varphi_i - \theta'_k}{\varphi_i - \varphi_{i-1}}\right) & \text{, if } 0 \le \frac{\varphi_i - \theta'_k}{\varphi_i - \varphi_{i-1}} \le 1 \\ \cos^2\left(\frac{\pi}{2}\frac{\theta'_k - \varphi_i}{\varphi_{i+1} - \varphi_i}\right) & \text{, if } 0 \le \frac{\theta'_k - \varphi_i}{\varphi_{i+1} - \varphi_i} \le 1 \\ 0 & \text{, otherwize} \end{cases} \quad \text{[Equation 9]}$$

Here, $\beta_{ik}$, i, and k respectively represent the direction weight, an index of virtual microphones, and an index of a sound source (or, an index of a position of the sound source). Equation 9 represents the direction weight when a front, to which one virtual microphone is headed, is set as 0 degrees, and angles formed between the one virtual microphone and other two virtual microphones, which are located right and left, are respectively set as ±90 degrees. In other words, Equation 9 provides the method in which a sound source signal from 90 degrees of each of a left and right direction, that is, the sound source signal from 180 degrees of a forward direction, in which the one virtual microphone faces, is amplified and other signals are given a direction weight 0. A correlation between an incident angle from the sound source and the direction weight, according to Equation 9, is visually illustrated in FIG. 8.

Figure 8:
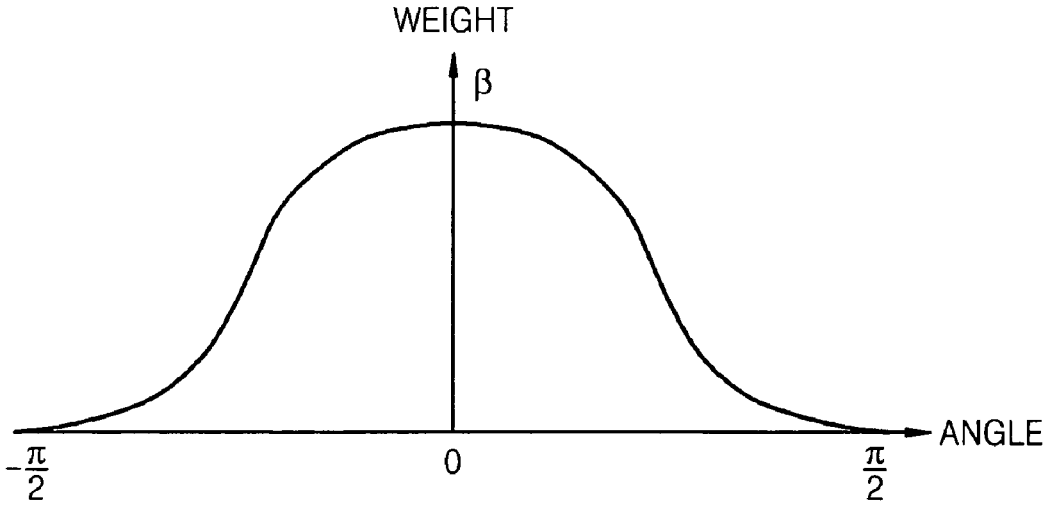
FIG. 8 is a graph illustrating the direction weight varying according to angles formed between a virtual microphone array and each of sound sources.

FIG. 8 is a graph illustrating the direction weight varying according to angles formed between a virtual microphone array and each of sound sources, wherein the horizontal axis is an angle, and the vertical axis is a weight. As shown in FIG. 8, the weight of 90 degrees is allowed to both sides of a center (that is, a front direction) having 0 degrees. In this regard, it is possible to understand that a sound source signal from the front direction has the largest weight, and that the weight decreases when the angle becomes larger. In general, the strength of the sound source signal from the front direction is greater than the strength of a sound source signal from a rear direction, and thus, the graph of FIG. 8 is appropriate so as to acquire the multi-channel sound having the stereoscopic effect.

Referring back to FIG. 6, a procedure below will now to be described.

The signal direction adjuster 242 adjusts a size of the sound source signals, according to the direction weight calculated by the direction weight calculator 241. This procedure is performed by multiplying the compensated sound source signals by the calculated direction weight, as shown in Equation 10 below.

$$z_i(t) = \sum_k \beta_{ik} \cdot s'_k(t) \quad \text{[Equation 10]}$$

Here, $Z_i(t)$ represents an output sound source signal that is compensated for, and $S'_k(t)$ represents one of the sound source signals whose distance is compensated for by a distance compensator (the distance compensator 230 of FIG. 2). That is, by using Equation 10, the direction compensation is performed for each of the sound sources, up to an index k of the respective sound sources, and an output sound source signal is generated by calculating the compensated sound source signals.

The multi-channel sound acquisition apparatus using a microphone array of FIG. 2 has been described above. The embodiment of the present invention may acquire the multi-channel sound having the stereoscopic effect from the sound source signals which are input from a microphone array included in a portable sound acquisition device. In particular, the embodiment of the present invention uses the amplitude (the distance) compensation and the direction (the angle) compensation, thereby effectively acquiring the multi-channel sound, even at a position that is distant from the sound sources.

Figure 3:
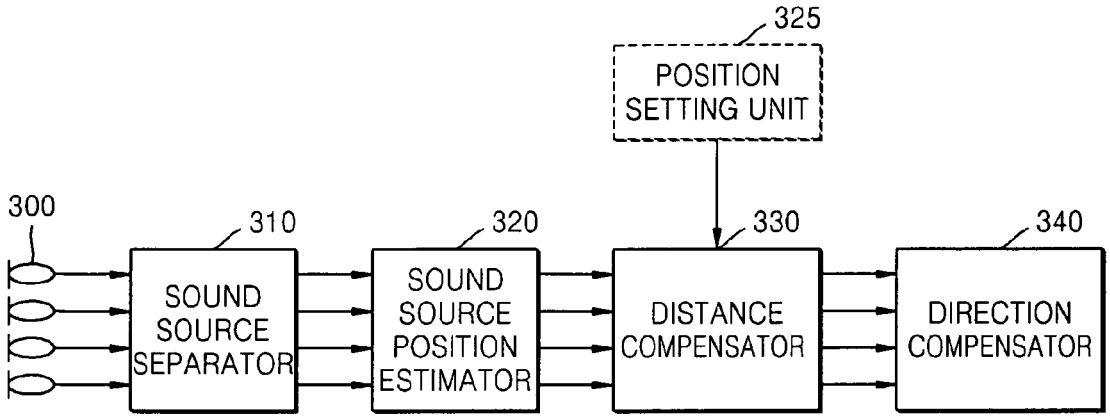
FIG. 3 is a block diagram in which a position setting unit is added to a multi-channel sound acquisition apparatus using a microphone array according to another embodiment of the present invention.

FIG. 3 is a block diagram in which a position setting unit 325 is added to a multi-channel sound acquisition apparatus using a microphone array according to another embodiment of the present invention. The multi-channel sound acquisition apparatus includes a microphone array 300, a source separator 310, a sound source position estimator 320, the position setting unit 325, a distance compensator 330, and a direction compensator 340. Except for the position setting unit 325, the rest of the components are the same as those described with reference to the multi-channel sound acquisition apparatus using a microphone array, illustrated in FIG. 2. Thus, hereinafter, the position setting unit 325 will be primarily described.

As described above, the distance compensator 330 receives position information of sound sources estimated by the sound source position estimator 320 and position information of an arbitrarily set virtual microphone, thereby calculating relative positions of the sound sources in relation to the virtual microphone array. Here, the position setting unit 325 serves to set the position of the virtual microphone. That is, the position setting unit 325 sets an arbitrary position as the position of the virtual microphone array, according to one of a user input value, a pre-stored setting value, an estimation value estimated by another device capable of estimating a distance of a target sound, and a value in which the positions of the sound sources estimated by the sound source position estimator 320 are considered. Also, the arbitrary position may be a position closer to the sound sources, compared to an actual microphone array, so that the multi-channel sound may be acquired in the vicinity of the sound sources.

Such a position setting unit 325 may set the position of the virtual microphone array by using various methods. For example, specific distance information may be input by a user via a user interface included in a portable device capable of acquiring a sound source, a predetermined distance pre-stored in a specific storage device may be called and used, or the position setting unit 325 may be linked to a zoom control device such as a zoom lens of a moving picture capturing device so that the position may be set as a variable value. Due to such a variety of methods, various position setting means may be provided so as to acquire the multi-channel sound, and the multi-channel sound acquisition apparatus according to the embodiment of the present invention is enabled to be manufactured so as to be suitable for an environment in which a microphone array is used.

Figure 9:
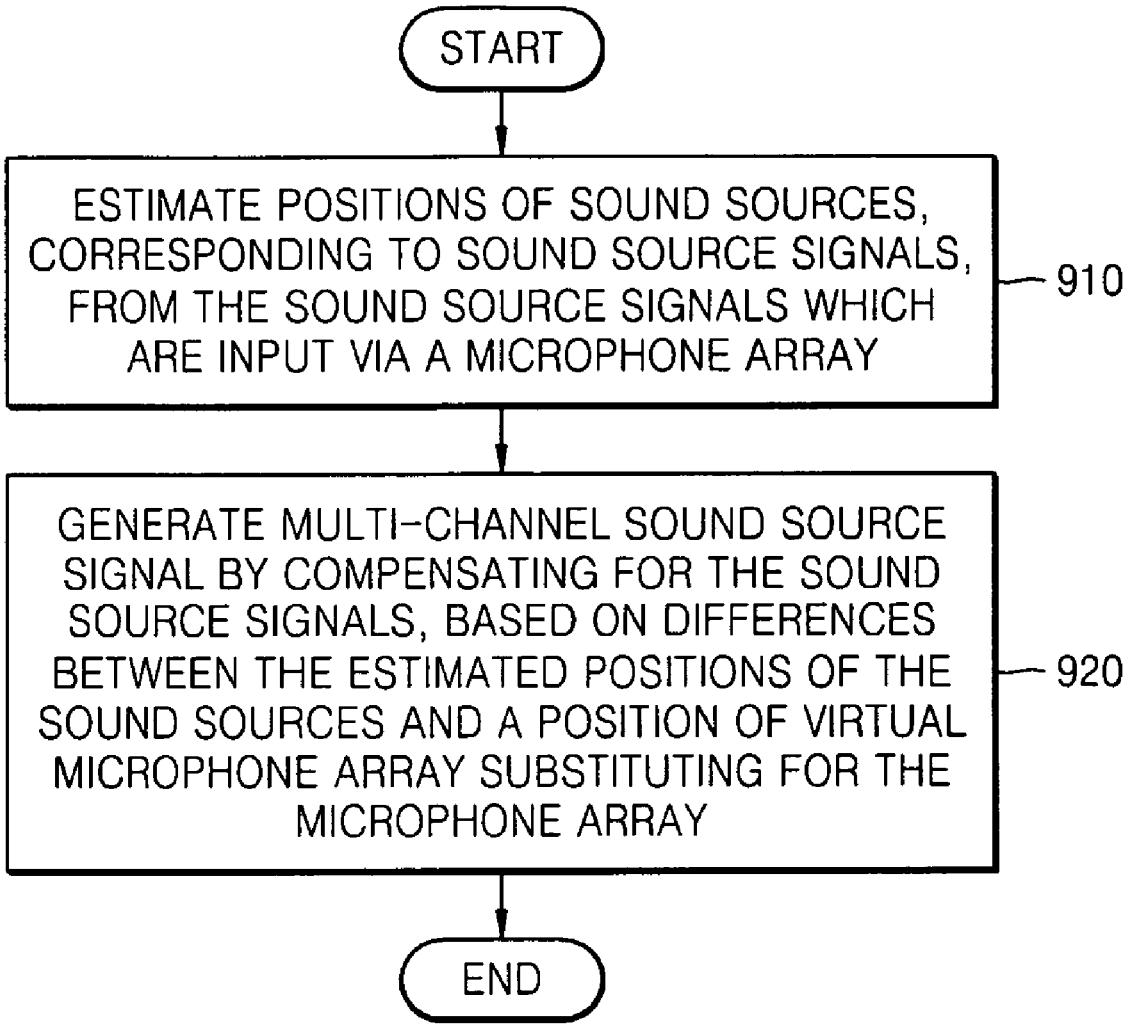
FIG. 9 is a flowchart of a method of acquiring a multi-channel sound by using a microphone array, according to an embodiment of the present invention.

FIG. 9 is a flowchart of a method of acquiring a multi-channel sound by using a microphone array, according to an embodiment of the present invention.

In operation 910, positions of sound sources corresponding to sound source signals are estimated from the sound source signals input via the microphone array. For this, the sound source signals are separated from mixed sound emitted from the sound sources existing in the vicinity of the microphone array. The various sound source separation algorithms as described above may be applied to a method of separating the sound source signals, and a separation method has been already described in relation to the sound source separator 210 of FIG. 2. Next, the positions (that is, directions and distances related to the positions of the sound sources) of the sound sources corresponding to the separated sound source signals are estimated. This estimation procedure may vary according to the various sound source separation algorithms, and various embodiments related to the estimation procedure have already been described in relation to the sound source position estimator 220 of FIG. 2, and thus, a detailed description thereof will be omitted here.

In operation 920, the sound source signals are compensated for based on a difference between the sound sources positions estimated in operation 910 and a position of a virtual microphone array substituting for the microphone array, so that a multi-channel sound source signal is generated. For this, the amounts by which the sound source signals are compensated for are the distances between the sound sources and the virtual microphone array so that a sound source signal corresponding to the position of the virtual microphone array is generated, and the amounts by which the directions of the sound source signals are compensated for are the angles formed between the virtual microphone array and the sound sources. By doing so, the multi-channel sound source signal is finally generated. This procedure has been already described in relation to the distance compensator 230 and the direction compensator 240, which are illustrated in FIG. 2, and thus, a detailed description thereof will be omitted here.

According to the aforementioned embodiments of the present invention related to the method of acquiring the multi-channel sound by using the microphone array, a multi-channel sound having the stereoscopic effect can be acquired from the sound source signals input via the microphone array. In particular, the multi-channel sound can be effectively acquired even at a position that is distant from the sound sources.

The computer readable codes on a computer readable recording medium can also be embodied. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the embodiment of the present invention can be easily construed by programmers of ordinary skill in the art to which the embodiment pertains.

While this invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A method of acquiring a multi-channel sound, the method comprising:

estimating positions of sound sources corresponding to sound source signals, which are mixed together, from the sound source signals input via a microphone array; and generating a multi-channel sound source signal by compensating for the sound source signals, based on differences between the estimated positions of the sound sources and a position of a virtual microphone array substituting for the microphone array.

2. The method of claim 1, wherein the generating comprises:

compensating for the sound source signals by distances between each of the sound sources and the virtual microphone array; and compensating for the sound source signals by angles formed between each of the sound sources and the virtual microphone array.

3. The method of claim 2, wherein the compensating by the distances comprises:

calculating relative positions of the sound sources in relation to the virtual microphone array, based on the estimated positions of the sound sources and the position of the virtual microphone array;

calculating a distance compensation coefficient corresponding to differences between distances from the sound sources to the microphone array and distances from the sound sources to the virtual microphone array, based on the calculated relative positions; and adjusting a size of the sound source signals, according to the calculated distance compensation coefficient.

4. The method of claim 2, wherein the compensating by the angles comprises:

calculating a direction weight according to the angles formed between the virtual microphone array and each of the sound sources; and adjusting a size of the sound source signals, according to the calculated direction weight.

5. The method of claim 4, wherein the direction weight increases when the positions of the sound sources approach_a maximum sensitivity direction of the virtual microphone array.

6. The method of claim 1, further comprising setting the position of the virtual microphone array, according to one of a user input value, a pre-stored setting value, an estimation value estimated by another device capable of estimating a distance of a target sound, and a value in which the estimated positions of the sound sources are considered.

7. The method of claim 1, further comprising separating the sound source signals from a mixed sound input via the microphone array, by using a predetermined sound source separation method, wherein the estimating comprises estimating the positions of the sound sources corresponding to the separated sound source signals.

8. A computer readable recording medium having recorded thereon a program for executing the method of claim 1 on a computer.

9. An apparatus for acquiring a multi-channel sound, the apparatus comprising:

a sound source position estimator estimating positions of sound sources corresponding to sound source signals, which are mixed together, from the sound source signals input via a microphone array; and a multi-channel sound source signal generator generating a multi-channel sound source signal by compensating for the sound source signals, based on differences between the estimated positions of the sound sources and a position of a virtual microphone array substituting for the microphone array.

10. The apparatus of claim 9, wherein the multi-channel sound source signal generator comprises:

a distance compensator compensating for the sound source signals by distances between each of the sound sources and the virtual microphone array; and a direction compensator compensating for the sound source signals by angles formed between each of the sound sources and the virtual microphone array.

11. The apparatus of claim 10, wherein the distance compensator comprises:

a relative position calculator calculating relative positions of the sound sources in relation to the virtual microphone array, based on the estimated positions of the sound sources and the position of the virtual microphone array;

a compensation coefficient calculator calculating a distance compensation coefficient corresponding to differences between distances from the sound sources to the microphone array and distances from the sound sources to the virtual microphone array, based on the calculated relative positions; and a signal distance adjuster adjusting a size of the sound source signals, according to the calculated distance compensation coefficient.

12. The apparatus of claim 10, wherein the direction compensator comprises:

a direction weight calculator calculating a direction weight according to the angles formed between the virtual microphone array and each of the sound sources; and a signal direction adjuster adjusting a size of the sound source signals, according to the calculated direction weight.

13. The apparatus of claim 12, wherein the direction weight increases when the positions of the sound sources approach a maximum sensitivity direction of the virtual microphone array.

14. The apparatus of claim 9, further comprising a position setting unit setting the position of the virtual microphone array, according to one of a user input value, a pre-stored setting value, an estimation value estimated by another device capable of estimating a distance of target sound, and a value in which the estimated positions of the sound sources are considered.

15. The apparatus of claim 9, further comprising a sound source separator separating the sound source signals from a mixed sound input via the microphone array, by using a predetermined sound source separation method, wherein the sound source position estimator estimates the positions of the sound sources corresponding to the separated sound source signals.

* * * * *